United States Patent [19]

Tokura

[11] 4,148,188

[45] Apr. 10, 1979

[54] INTERNAL COMBUSTION ENGINE EQUIPPED WITH CATALYTIC CONVERTER

[75] Inventor: Naomi Tokura, Yokosuka, Japan

[73] Assignee: Nissan Motor Company, Limited, Yokohama, Japan

[21] Appl. No.: 764,984

[22] Filed: Feb. 2, 1977

[30] Foreign Application Priority Data

Feb. 6, 1976 [JP] Japan ..... 51-11909

[51] Int. Cl.[2] ..... F01N 3/15

[52] U.S. Cl. ..... 60/276; 60/285; 60/289

[58] Field of Search ..... 690/276, 285, 289

[56] References Cited

U.S. PATENT DOCUMENTS

| | | | |
|---|---|---|---|
| 3,745,768 | 7/1973 | Zechnall | 60/285 |
| 3,949,551 | 4/1976 | Eichler | 60/285 |
| 3,986,352 | 10/1976 | Casey | 60/276 |
| 4,006,718 | 2/1977 | Konomi | 60/276 |
| 4,023,359 | 5/1977 | Masaki | 60/289 |

*Primary Examiner*—Douglas Hart

*Attorney, Agent, or Firm*—Lowe, King, Price & Becker

[57] ABSTRACT

Above a selected temperature the amount of fuel supplied into the air stream inducted into the combustion chamber is controlled so that the resulting air-fuel mixtures cause exhaust gases having air-fuel ratios of 145:1 to 15.5:1 whereby neither hydrogen sulfide nor sulfuric acid mist is formed in an oxidation type catalytic converter.

4 Claims, 3 Drawing Figures

INTERNAL COMBUSTION ENGINE EQUIPPED WITH CATALYTIC CONVERTER

This invention relates to an internal combustion engine equipped with an oxidation type catalytic converter in its exhaust system for oxidizing the unburned constituents contained in the exhaust gases discharged from the combustion chambers of the engine.

It is the prime object of the present invention to provide an improved internal combustion engine which is capable of eliminating problems caused by employing an oxidation catalytic converter for oxidizing the unburned constituents contained in the exhaust gases discharged from the combustion chambers of the engine.

Another object of the present invention is to provide an improved internal combustion engine which is capable of preventing the emission of foul and noxious gases such as hydrogen sulfide and sulfuric acid mist into the atmosphere throughout all operating conditions of the engine.

A further object of the present invention is to provide an improved internal combustion engine in which the air-fuel ratio of the exhaust gases upstream of the oxidation catalytic converter is regulated within the range from 14.5:1 to 15.5:1 whereby neither hydrogen sulfide nor sulfuric acid mist is formed in the exhaust system of the engine.

A still further object of the present invention is to provide an improved internal combustion engine in which the air-fuel ratio of the exhaust gases upstream of the oxidation catalyst is regulated within the range from 14.5:1 to 15.5:1 only when the temperature of the oxidation catalyst is above a predetermined level above which hydrogen sulfide and sulfuric acid mist are both formed, thereby preventing the deterioration of engine performance characteristics.

Other objects, features, and advantages of the engine according to the present invention will become more apparent from the following description taken in conjunction with the accompanying drawings, in which.

Figure 1:
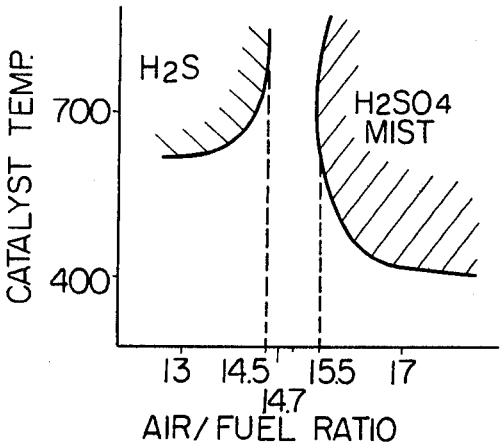
FIG. 1 is a graph showing the formation of hydrogen sulfide and sulfuric acid mist in terms of the temperature of the oxidation catalyst and the air-fuel ratio of the exhaust gases.

In connection with an internal combustion engine equipped with a catalytic converter in its exhaust system for oxidizing the unburned constituents contained in the exhaust gases, it is undesirable that sulfuric acid mist and foul odors are emitted through the exhaust system of the engine into the atmosphere. However, the above has been shown to happen when, as shown in FIG. 1, the air-fuel (combustibles) ratio of the exhaust gases upstream of the catalytic converter is lower than stoichiometric, a reducing atmosphere is produced in the exhaust gases because of the existence of a relatively large amount of carbon monoxide and unburned hydrocarbons. Under this condition, if sulfur is contained in the fuel fed to the engine, the sulfur reacts with hydrogen in the exhaust gases to produce hydrogen sulfide ($H_2S$) at a temperature above about 600° C. and accordingly toxic exhaust gases with bad smells or foul odors are discharged from the exhaust system of the engine into the atmosphere. Conversely, when the air-fuel ratio of the exhaust gases is higher than stoichiometric, the sulfur is oxidized by the action of the oxidation catalyst in the catalytic converter at a high temperature above about 450° C. to produce $SO_3$ gas and thereafter the $SO_3$ gas is mixed with water in the exhaust gases to form sulfuric acid mist.

In general, the air-fuel ratio of the exhaust gases upstream of the oxidation catalytic converter is controlled within the range from 16:1 to 17:1 which is most suitable for the oxidation reaction carried out in the catalytic converter, by means of operating the engine on a lean air-fuel mixture or supplying secondary air into the exhaust system upstream of the catalytic converter. Accordingly, the sulfuric acid mist may be formed under the condition in which the temperatures in the exhaust gases and the oxidation catalyst are considerably raised such as, for example, during high engine speed operation.

However, the air-fuel mixture supplied to the combustion chamber of the engine is temporarily enriched during low engine speed and engine load operation, deceleration, idling, and high engine speed and engine load operation in order to obtain smooth and stable engine running and high engine power output. Under such a condition, hydrogen sulfide may be produced in the exhaust system when the temperature of the exhaust gases is considerably raised and consequently bad smells or foul odors due to the hydrogen sulfide may be emitted out of the exhaust system of the engine.

In view of the above, the present invention contemplates to prevent formation of hydrogen sulfide and sulfuric acid mist in the exhaust system of the engine by suitably controlling air-fuel ratio of the exhaust gases upstream of the catalytic converter using feedback control techniques.

Figure 2:
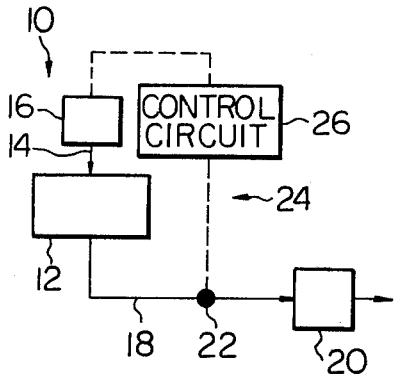
FIG. 2 is a schematical illustration of a preferred embodiment of an internal combustion engine in accordance with the present invention.

Referring now to FIG. 2 of the drawing, a preferred embodiment of an internal combustion engine in accordance with the present invention is shown in a schematical illustration, in which the engine, generally designated by the reference numeral 10, is operated on a fuel containing a small amount of sulfur and comprises an engine proper 12 having at least one combustion chamber (no numeral). The combustion chamber is communicated at its inlet port (not identified) through an air induction passageway 14 with the atmosphere to induct atmospheric air into the combustion chamber. The reference numeral 16 indicates a fuel supply device or fuel supply means for controllably supplying the fuel into the stream of air passing through the air induction passage 14 to form an air-fuel mixture to be fed into the combustion chamber. The fuel supply device 16 may be a device including an electromagnetic valve for controllably supplying fuel in the float chamber of a carburetor (not shown) into the air-fuel induction passage of the carburetor, or an electronically controlled fuel injection device (not shown) for controllably injecting the fuel into the air induction passageway of the engine.

The combustion chamber is connected at its outlet port (not identified) through an exhaust gas passageway 18 to a catalytic converter 20 having therein an oxidation catalyst (not shown) in order to introduce the exhaust gases discharged from the combustion chamber into the catalytic converter 20. The catalytic converter 20 is arranged to oxidize and convert the noxious unburned constituents such as carbon monoxide (CO) and hydrocarbons (HC) contained in the exhaust gases into innoxious compounds and thereafter to discharge purified exhaust gases into the atmosphere.

Disposed in the exhaust gas passageway 18 upstream of the catalytic converter 20 is an exhaust gas sensor 22 forming part of control means 24. The exhaust gas sensor 22 is arranged to generate an information signal representing the composition of the exhaust gases passing through the exhaust gas passageway 18. In this case, the exhaust gas sensor 22 is an oxygen sensor which is arranged to generate the information signal representing the concentration of oxygen contained in the exhaust gases. The exhaust gas sensor 22 is electrically connected to a control circuit 26 which is, in turn, connected to the fuel supply device 16 and arranged to always control, in response to the information signal applied thereto, the amount of the fuel supplied from the fuel supply device 16 such that the combustion chamber is fed with the air-fuel mixtures having a predetermined range of air-fuel ratios which cause, when combusted, the exhaust gases having air-fuel (combustibles) ratios ranging from 14.5:1 to 15.5:1, the exhaust gases being discharged into the exhaust gas passageway 18 upstream of the catalytic converter 20. This air-fuel ratio upstream of the catalytic converter 20 is referred to as "an overall air-fuel ratio" because it corresponds to the ratio between the total air and the total fuel which are supplied throughout the intake system to exhaust system of the engine.

With the arrangement hereinbefore described, when the oxygen sensor 22 generates the information signal representing that the oxygen concentration in the exhaust gases exceeds a predetermined range which corresponds to the air-fuel ratios ranging from 14.5:1 to 15.5:1, the control circuit 26 to which the information signal is applied controls the fuel supply device 16 to increase the amount of the fuel supplied therefrom. Conversely, when the oxygen sensor 22 generates the information signal representing that the oxygen concentration in the exhaust gases is below the predetermined range, the amount of the fuel supplied from the fuel supply device 16 is increased. Thus, the overall air-fuel ratio of the air-fuel mixture upstream of the catalytic converter 20 is regulated within the range from 14.5:1 to 15.5:1 using feedback control techniques discussed hereinbefore. In this connection, as is apparent from FIG. 1, neither hydrogen sulfide nor sulfuric acid mist may be produced within the above range of the air-fuel ratio of the exhaust gases upstream of the catalytic converter 20.

Therefore, the engine according to the present invention never emits into the atmosphere foul odors due to hydrogen sulfide and harmful sulfuric acid mist and accordingly may emit only harmless carbon dioxide ($CO_2$) and water vapour ($H_2O$) which are converted by the action of the oxidation catalyst from carbon monoxide and hydrocarbons contained in the exhaust gases discharged from the combustion chamber of the engine.

Figure 3:
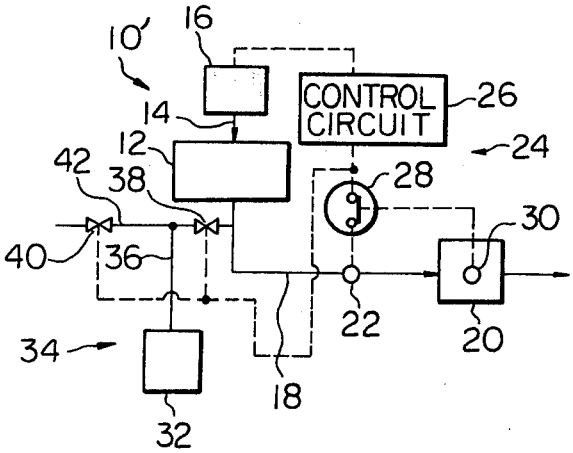
FIG. 3 is a schematical illustration of another preferred embodiment of the engine in accordance with the present invention.

FIG. 3 illustrates another preferred embodiment of the engine according to the present invention, in which the engine 10' is adapted to be operated on an air-fuel mixture richer than stoichiometric to obtain smooth and stable engine running and high engine output power performance, or on an air-fuel mixture leaner than stoichiometric. In this case, like reference numerals as in FIG. 2 designate like parts and elements for the purpose of simplicity of illustration. As shown, a switch 28 is disposed or electrically connected between the exhaust gas sensor 22 and the control circuit 26, and arranged to close to establish the electrical connection between the exhaust gas sensor 22 and the control circuit 26 and to open to interrupt the electrical connection between the same. The switch 28 is electrically connected to a temperature sensor 30 disposed in contact with the oxidation catalyst in the catalytic converter 20, the temperature sensor being arranged to normally allow the switch 22 to open and to cause the switch 28 to close when the temperature in the oxidation catalyst exceeds a predetermined level or a temperture of 450° C. above which both hydrogen sulfide and sulfuric acid mist are formable in the exhaust system as apparent from FIG. 1.

Reference numeral 32 indicates a secondary air source such an air pump which forms part of secondary air supply means 34 and is connected through a secondary air supply pipe 36 to the exhaust gas passageway 18 to supply secondary air under pressure into the exhaust gas passageway 18 when the operation of the control means 24 is stopped. A first electromagnetic valve 38 is disposed in the secondary air supply pipe 36 and electrically connected between the switch 28 and the control circuit 26. The first electromagnetic valve 38 is arranged to open to establish fluid communication between the secondary air source 32 and the exhaust gas passageway when the switch 28 opens and to close to block the fluid communication between the same when the switch 28 closes. A second electromagnetic valve 40 is disposed in a secondary air vent pipe 42 branched off from the secondary air supply pipe 36 beteween the secondary air source 32 and the first electromagnetic valve 38, and electrically connected between the switch 28 and control circuit 26. The second electromagnetic valve 40 is arranged to open to vent or leak the secondary air from the secondary air source 32 when the first electromagnetic valve 38 closes and to close to block the fluid communication between the secondary air source 32 and the atmosphere when the first electromagnetic valve 38 opens.

With the thus arranged engine, when the temperature of the oxidation catalyst in the catalytic converter 20 is below the predetermined level, the switch 28 opens to interrupt the connection between the exhaust gas sensor 22 and the control circuit 26 to stop the operation of the control means 24. Accordingly, the combustion chamber of the engine proper 12 is supplied with the air-fuel mixture having a pre-set air-fuel ratio and therefore, for example, smooth and stable engine running during idling and high engine power output during high load engine operation are obtained. It will be understood that no problem arises under such a condition because, as apparent from FIG. 1, hydrogen sulfide and sulfuric acid mist are not formed until the oxidation catalyst temperature exceeds 600° C. and 450° C., respectively.

When the temperature in the oxidation catalyst exceeds the predetermined level, the switch closes to begin operation of the control means 24 in response to the exhaust gas composition and therefore the air-fuel ratio of the exhaust gases upstream of the catalytic converter 20 is regulated within the range from 14.5:1 to 15.5:1, preventing formation of hydrogen sulfide and sulfuric acid mist. It will be understood that, by this engine according to the present invention, emission of foul odors due to hydrogen sulfide and of sulfuric acid mist is prevented throughout all the engine operating ranges without deterioration of the engine performance characteristics and capability of the catalytic converter.

What is claimed is:

1. An internal combustion engine having a combustion chamber and being operated on a fuel containing sulfur, comprising:

fuel supply means for controllably supplying the fuel into an air induction passageway communicating the atmosphere and the combustion chamber to induct air into the combustion chamber;

a catalytic converter having therein an oxidation catalyst for oxidizing the unburned constituents contained in the exhaust gases discharged from the combustion chamber, said catalytic converter being connected to the combustion chamber through an exhaust gas passageway;

an exhaust gas sensor disposed in the exhaust gas passageway upstream of said catalytic converter and arranged to generate an information signal representing the composition of the exhaust gases passing through the exhaust gas passageway;

a control circuit electrically connected between said exhaust gas sensor and said fuel supply means and arranged to control, in response to the information signal, the amount of fuel supplied from said fuel supply means to feed the combustion chamber with an air-fuel mixture having an air-fuel ratio within a range which develops exhaust gases having an air-fuel ratio ranging from 14:1 to 15.5:1, said exhaust gases being discharged into the exhaust gas passageway upstream of said catalytic converter;

means for interrupting the electrical connection between said exhaust gas sensor and control circuit to stop the control operation of said control circuit when the temperature in the oxidation catalyst in said catalytic converter is below a predetermined temperature above which at least one of hydrogen sulfide and sulfuric acid is formable;

the interrupting means including a switch disposed between said exhaust gas sensor and said control circuit, said switch being operated to (1) close to establish the electrical connection between said exhaust gas sensor and said control circuit and (2) open to interrupt the electrical connection between the same, and a temperature sensor disposed in said catalytic converter and electrically connected to said switch, said temperature sensor being arranged to normally allow the switch to open and to cause the switch to close when the temperature in said oxidation catalyst in said catalytic converter exceeds said predetermined temperature; and secondary air supply means for supplying secondary air into the exhaust gas passageway upstream of said exhaust gas sensor while the electrical connection between said exhaust gas sensor and said control circuit is interrupted, said secondary air supply means including a secondary air source connected through a secondary air supply pipe to the exhaust gas passageway for supplying under pressure secondary air into the exhaust gas passageway, and a first electromagnetic valve disposed in the secondary air supply pipe which is arranged to open to establish the fluid communication between said air source and the exhaust gas passageway and to close to block the fluid communication between the same, said first electromagnetic valve being electrically connected between said switch and said control circuit to close when said switch closes and to open when said switch opens 2. An internal combustion engine as claimed in claim 1, in which the said predetermined temperature is about 450° C.

3. An internal combustion engine as claimed in claim 1, in which said secondary air supply means further includes a second electromagnetic valve disposed in a secondary air vent pipe branched off from the secondary air supply pipe between said secondary air source and said first electromagnetic valve, said second electromagnetic valve being arranged to open to vent the secondary air from said secondary air source into the atmosphere when said first electromagnetic valve closes and to close to block the fluid communication between said secondary air source and the atmosphere when said first electromagnetic valve opens.

4. An internal combustion engine as claimed in claim 1, in which said exhaust gas sensor is an oxygen sensor which is arranged to generate an information signal representing the concentration of oxygen contained in the exhaust gases passing through the exhaust gas passageway.

* * * * *